US009599087B2

(12) United States Patent
Plaideau

(10) Patent No.: US 9,599,087 B2
(45) Date of Patent: Mar. 21, 2017

(54) ELECTROMAGNETIC SWITCH FOR THE STARTER OF A HEAT ENGINE, COMPRISING AT LEAST TWO MOVABLE CONTACTS

(71) Applicant: VALEO EQUIPEMENTS ELECTRIQUES MOTEUR, Creiteil (FR)

(72) Inventor: Stéphane Plaideau, Rochetoirin (FR)

(73) Assignee: Valeo Equipements Electriques Moteur (FR)

( * ) Notice: Subject to any disclaimer, the term of this patent is extended or adjusted under 35 U.S.C. 154(b) by 198 days.

(21) Appl. No.: 14/368,188

(22) PCT Filed: Dec. 21, 2012

(86) PCT No.: PCT/FR2012/053051
§ 371 (c)(1),
(2) Date: Jun. 23, 2014

(87) PCT Pub. No.: WO2013/093371
PCT Pub. Date: Jun. 27, 2013

(65) Prior Publication Data

US 2014/0345554 A1 Nov. 27, 2014

(30) Foreign Application Priority Data

Dec. 22, 2011 (FR) ..... 11 62255

(51) Int. Cl.
*H01H 50/54* (2006.01)
*F02N 11/08* (2006.01)
(Continued)

(52) U.S. Cl.
CPC ..... *F02N 11/0803* (2013.01); *F02N 11/08* (2013.01); *F02N 11/087* (2013.01);
(Continued)

(58) Field of Classification Search
CPC ..... H01H 51/065; H01H 50/54; H01H 1/24; H01H 9/42; F02N 11/0851; F02N 11/0803; F02N 11/08
See application file for complete search history.

(56) References Cited

U.S. PATENT DOCUMENTS 6,380,831 B1 * 4/2002 Kajino ..... F02N 11/087 335/126
6,762,663 B2 * 7/2004 Andoh ..... H01H 51/065 335/121

(Continued)

FOREIGN PATENT DOCUMENTS

DE 102010003485 10/2011
FR 2843427 2/2004

(Continued)

*Primary Examiner* — Bernard Rojas
(74) *Attorney, Agent, or Firm* — Berenato & White, LLC

(57) ABSTRACT

An electromagnetic switch for the starter of a heat engine, including a first terminal (B1), a second terminal (B2), a first mobile contact (C1) which is movable between an inactive position and a power supply position, and at least one second mobile contact (C2), which is placed between the first mobile contact (C1) and the second terminal (B2) and which is movable between a disconnected position and a connected position. The switch is capable of being placed in three operating states: an inactive state, an engagement state, and a power supply state.

23 Claims, 7 Drawing Sheets

(51) Int. Cl.

| | |
|---|---|
| ***H01H 51/06*** | (2006.01) |
| ***F02N 15/06*** | (2006.01) |
| *H01H 1/24* | (2006.01) |
| *H01H 9/42* | (2006.01) |

(52) U.S. Cl.
CPC ..... *F02N 11/0851* (2013.01); *F02N 15/067* (2013.01); *H01H 50/54* (2013.01); *H01H 51/065* (2013.01); *F02N 11/0814* (2013.01); *F02N 11/0844* (2013.01); *H01H 1/24* (2013.01); *H01H 9/42* (2013.01)

(56) References Cited

U.S. PATENT DOCUMENTS

| | | | | |
|---|---|---|---|---|
| 2005/0190024 | A1* | 9/2005 | McMahon ..... | H01H 1/5855<br>335/126 |
| 2009/0026896 | A1* | 1/2009 | Andoh ..... | F02N 11/087<br>310/68 R |

FOREIGN PATENT DOCUMENTS

| | | |
|---|---|---|
| FR | 2934933 | 2/2010 |
| FR | 2940719 | 7/2010 |
| WO | WO2005054664 | 6/2005 |

* cited by examiner

ELECTROMAGNETIC SWITCH FOR THE STARTER OF A HEAT ENGINE, COMPRISING AT LEAST TWO MOVABLE CONTACTS

CROSS-REFERENCE TO RELATED APPLICATIONS AND CLAIM TO PRIORITY

This application is a national stage application of International Application No. PCT/FR2012/053051 filed Dec. 21, 2012, which claims priority to French Patent Application No. 1162255 filed Dec. 22, 2011, of which the disclosures are incorporated herein by reference and to which priority is claimed.

FIELD OF THE INVENTION

The invention relates to the technical field of starters for motor vehicle heat engines.

BACKGROUND OF THE INVENTION

A starter generally comprises an electric motor associated with drive means of the internal combustion engine. The drive means are most often adapted to be coupled to the movable components of the internal combustion engine during a start-up phase of said engine and to be decoupled from the internal combustion engine when said engine operates. To this end, the starter comprises an electromagnetic switch adapted, on the one hand, to control the power supply of the electric motor and, on the other hand, to control the coupling and decoupling of the drive means of the internal combustion engine. The drive means comprise a launcher, which is rotationally mobile about itself and which is movable by axial translation between a rest position and a drive position of the internal combustion engine. The launcher is then moved between its rest and drive positions by a lever operated by the electromagnetic switch.

More specifically, the invention relates to such an electromagnetic switch, also referred to as contactor, for a starter for a motor vehicle.

When implementing the starter, it is necessary to ensure that the gear of the launcher is properly engaged in the drive position before starting the electric motor. In effect, in the event of the incorrect engagement of the launcher when starting the electric motor, there is a major risk of damaging the launcher and/or the starter ring rigidly connected to the internal combustion engine.

For this reason, a need has arisen for an electromagnetic switch that ensures that the launcher is engaged in the drive position before the electric motor of the starter is started.

SUMMARY OF THE INVENTION

In order to achieve this objective, the invention relates to an electromagnetic switch for a starter of a heat engine, comprising:

- a first terminal;
- a second terminal;
- a first movable contact, which is located between the first and second terminals and which is movable between a rest position and a power supply position;
- a plunger core, of a first coil, designed to activate a system for operating a launcher of the starter, controlling the displacement of the first movable contact;
- a second movable contact, which is located between the first movable contact and the second terminal and which can be moved, between a disconnected position and a connected position, by a core of a second coil and by a spring.

According to the invention, the switch is designed to be placed, according to the power supply of the coils, in three operating states, namely:

- a rest state, wherein the first movable contact is electrically isolated from the two terminals, and in that the two terminals are isolated from each other;
- an engaged state, wherein:
  - the first movable contact is in an engaged position between the power supply position and the rest position and is in electrical contact with the first electric terminal;
  - the second movable contact is in a rest position and in electrical and mechanical contact with the first movable contact;
  - the second terminal is electrically isolated from the movable contacts and the first terminal;
- a power supply state, wherein:
  - the first movable contact is in a power supply position and is in electrical contact with the second terminal through the second movable contact and is in electrical contact with the first terminal; and
  - the second movable contact is in a connected position and is in electrical and mechanical contact with the second terminal.

Given the three distinct states that can be known by the starter, it is possible to control the power supply of the motor by placing the switch in its power supply state after it has been placed in its engaged state.

According to one feature of the invention, the second movable contact is in a connected position when the second coil is powered and is in a disconnected position when the coil is deactivated, with a spring returning the movable contact to a disconnected position.

According to one feature of the invention, the second movable contact is in a connected position when the second coil is powered and is in a disconnected position when the coil is deactivated, with a spring returning the movable contact to a connected position.

According to a variant of this feature, the first contact exerts a force on the second movable contact and passes from the disconnected position to the connected position when the first contact passes from the engaged position to the power supply position.

According to a further feature of the invention, the second movable contact is in a disconnected position when the second coil is powered and is in a connected position when the second coil is deactivated, and the second movable contact is held in a connected position by a spring.

According to one embodiment of the invention, the electromagnetic switch comprises:

1. a third movable contact, which is located between the first movable contact and the first terminal and which is moved, between a disconnected position and a shunting position, by a core of a third coil and by a spring; and
1. a load resistor electrically mounted between the first terminal and the third movable contact;

wherein:

1. in the rest state, the third movable contact is electrically isolated from the other two movable contacts;
1. in the engaged state, the first movable contact is in electrical and mechanical contact with the third movable contact, and in that the third movable contact is in a disconnected position that is mechanically isolated from the third terminal and is electrically linked to the first terminal through the load resistor;

1. in the power supply state, the first movable contact is in electrical and mechanical contact with the third movable contact, the third movable contact is in a connected position and is in electrical and mechanical contact with the first terminal shunting the resistor;

and wherein, the switch is capable of passing to an intermediate state, wherein:

1. the first movable contact is in an engaged position and is in electrical and mechanical contact with the second and third movable contacts;
1. the third movable contact is in a disconnected position and is in electrical contact with the first terminal through the load resistor; and
1. the second movable contact is in a connected position and is electrically linked to the second terminal.

The four distinct states of the switch allow precise control of the starter integrating the switch according to the invention. In particular, this embodiment allows the use of a resistor in series with the electric motor for a short duration when the electric motor is powered.

According to a further feature of this embodiment, the third movable contact is in a disconnected position when the third coil is activated.

According to a further feature of this embodiment, the first movable contact exerts a mechanical force on the third movable contact so as to move the third movable contact toward the shunting position when the third coil is not powered, and in that a return spring applies a force to the third movable contact toward the disconnected position and is held in the disconnected position by a spring.

In this embodiment, the third movable contact is permanently electrically connected, via a load resistor, to the second terminal so that in the intermediate state the load resistor is powered and in the power supply state the resistor is short-circuited. This feature allows a rotation of the electric motor to be controlled in the intermediate state with less power than is available in the power supply state.

According to one feature of the invention, the second and/or the third coil is a micro-solenoid.

According to a variant of this feature, the second and/or the third movable contact is formed by a contact stirrup comprising two jaws that hold together the core of the micro-solenoid, which is also located between the two jaws. The contact stirrup is then preferably adapted to support the passage of a power current.

According to a further variant of this feature, the micro-solenoid comprises a shell forming part of the magnetic circuit of the micro-solenoid and forming a housing for the coil of the micro-solenoid. The shell is then preferably rigidly connected to a wall of the switch.

According to one embodiment, the contact stirrup is adapted to support the passage of a power current.

According to one embodiment, the micro-solenoid comprises a shell forming part of the magnetic circuit of the micro-solenoid and forming a housing for the coil of the micro-solenoid.

According to one embodiment, the shell is rigidly connected to the body of the switch.

The invention further relates to an electric starter for an internal combustion engine, comprising:

a launcher, which is rotationally driven by an electric motor and which is movable by axial translation between a rest position and an engaged position with drive means of the internal combustion engine;

an electromagnetic switch as previously described adapted, on the one hand, to control the power supply of the electric motor and, on the other hand, to control the displacement of the launcher between its rest and engaged positions.

The invention further relates to a starter system comprising a starter as previously described, wherein the first coil comprises:

a pull-in winding with an output terminal electrically linked to the positive terminal of the motor; and a holding winding with an output terminal electrically linked with the negative terminal of the motor and an input terminal linked to an input terminal of the pull-in coil;

wherein said system further comprises:

an electric battery comprising a positive terminal linked to the second terminal of the switch and a negative terminal linked to a terminal of the electric motor;

a first circuit breaker electrically linked from a first terminal to the positive terminal of the battery and from a second terminal to the holding and pull-in windings;

a second circuit breaker electrically linked from a first terminal to the positive terminal of the battery and from a second terminal to the input terminal of the second coil; and wherein the output terminal of the second coil is electrically linked to the positive terminal of the motor.

According to one feature of the previously described system, the output terminal of the second coil is connected to the output terminal of the pull-in winding of the first coil.

According to one feature of the aforementioned system, the third coil is connected between the third contact and the output terminal of the first coil.

Of course, the different variants and embodiments of the invention can be associated with each other according to various combinations insofar as they are not incompatible or exclusive from each other.

BRIEF DESCRIPTION OF THE DRAWINGS

Furthermore, various other features of the invention will become apparent from the appended description, which is provided with reference to the drawings according to the invention.

It is noteworthy that in these figures the various structural and/or functional elements common to the different variants can have the same alphanumeric references.

DETAILED DESCRIPTION

Figure 1:
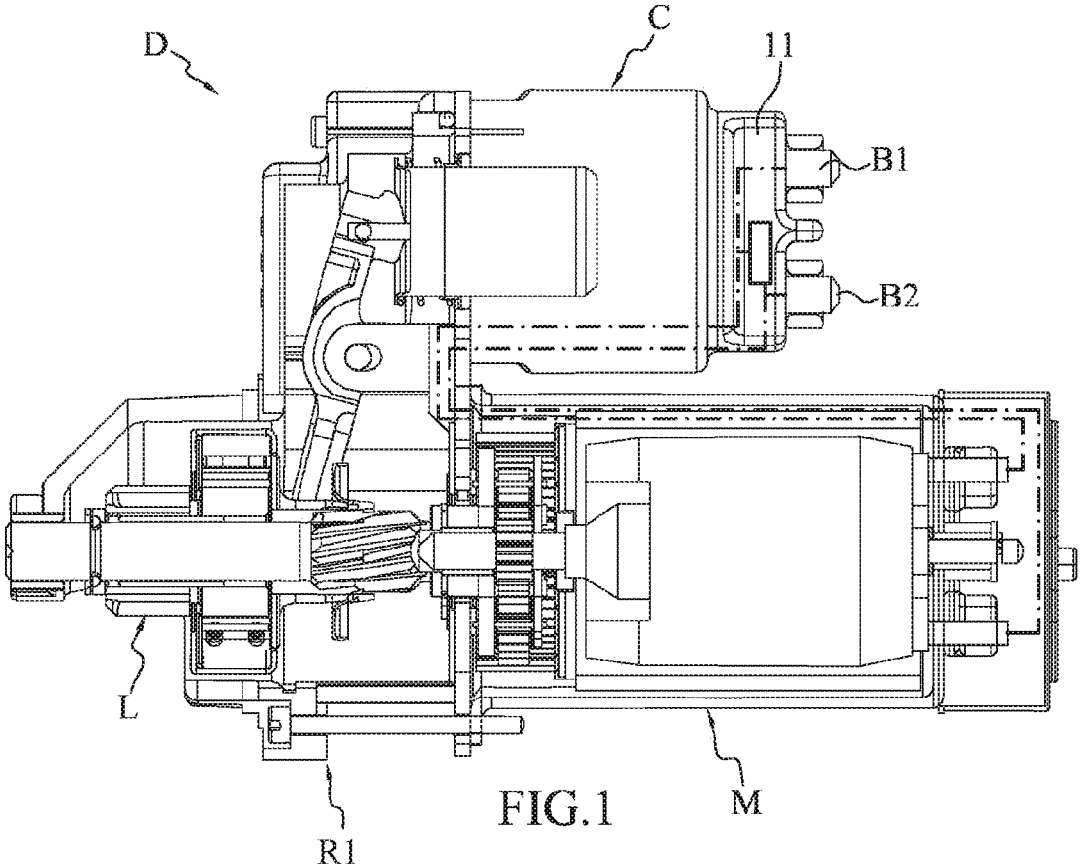
FIG. 1 is a partial extracted view of a starter for a heat engine, according to the invention.

As can be seen in FIG. 1, a starter D, according to the invention, for a heat engine comprises a front part A comprising a reducer R1 , on which an electric motor M is fixed that is controlled by an electromagnetic switch C that also controls a launcher L integrated into the front part A. The launcher L and the reducer R1 together form drive means of the internal combustion engine. The embodiment of such a starter D and its constituent elements is well known to a person skilled in the art and for this reason only those features will be described that are necessary to understand the invention. For further information relating to the details for producing a starter, details of which will not be provided hereafter, please refer to the documents FR 2934933 and 1933, FR 2843427 and WO 2005/054664.

Figure 2:
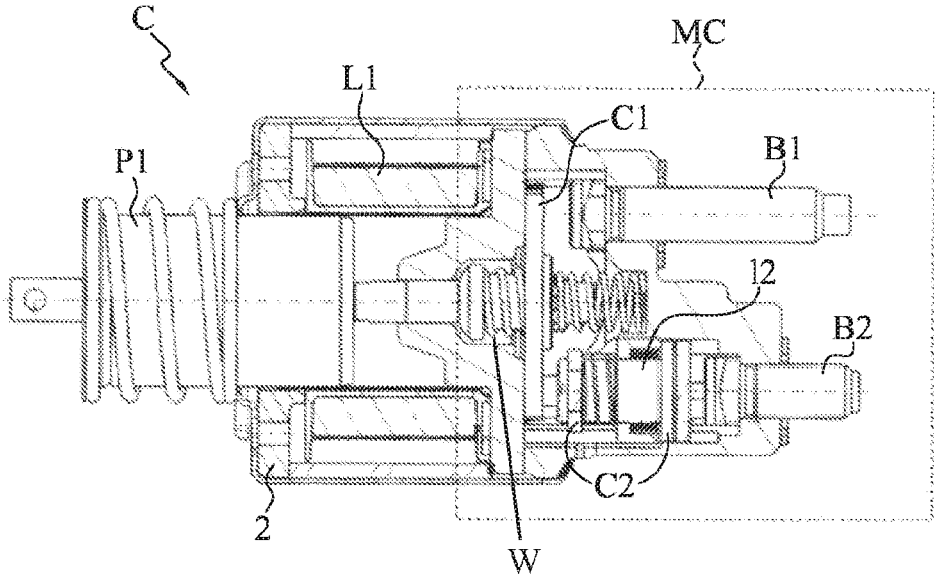
FIG. 2 is a schematic longitudinal section of the electromagnetic switch of the starter shown in FIG. 1.

The electromagnetic switch C comprises, as can be seen in FIG. 2, a first terminal B1 and a second terminal B2 that extend outside of the body 1 of the switch C. The first terminal B1 is, according to the example shown in FIG. 3, designed to be connected to a pole of a battery 2, whereas the second terminal B2 is designed to be connected to the electric motor M. The terminals B1 and B2 belong to a multi-contacts assembly MC constituting the switch C and shown schematically in FIG. 4.

In addition to the terminals B1 and B2, the multi-contacts assembly MC comprises a first movable contact C1, which is located between the first and second terminals B1 and B2. The first movable contact C1 is activated by a plunger P1 of a first coil L1. The plunger P1 is also adapted to move the launcher L between rest and engaged positions. The first coil L1 comprises two windings Em and Ea that have a common end connected to a control unit U. A first winding Em, referred to as holding winding, is also directly connected to the ground of the vehicle, whereas the other winding Ea, referred to as pull-in winding, is also connected to the second terminal B2.

The multi-contacts assembly MC further comprises a second movable contact C2, which is located between the first movable contact C1 and the second terminal B2. The second movable contact C2 is moved by the core P2 of a second coil L2 that is connected, on the one hand, to the control unit U and, on the other hand, to the second terminal B2.

Figure 5:
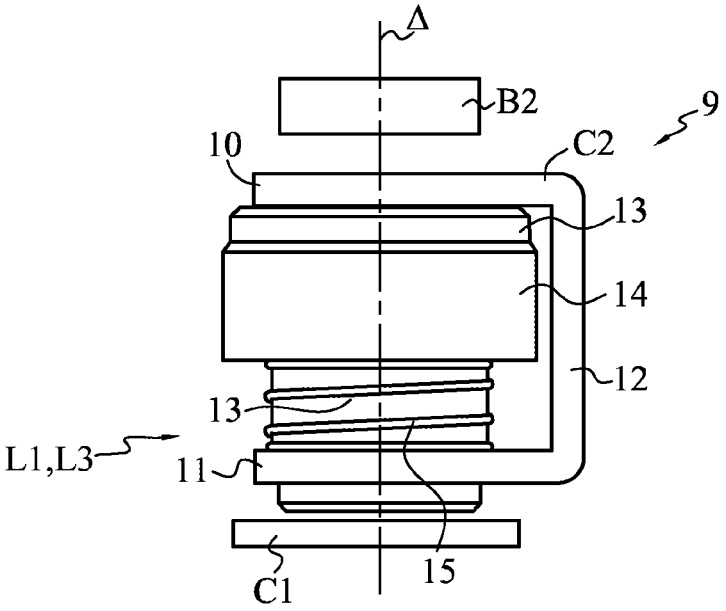
FIG. 5 is a side view of a micro-solenoid constituting a coil of a switch according to the invention.
Figure 6:
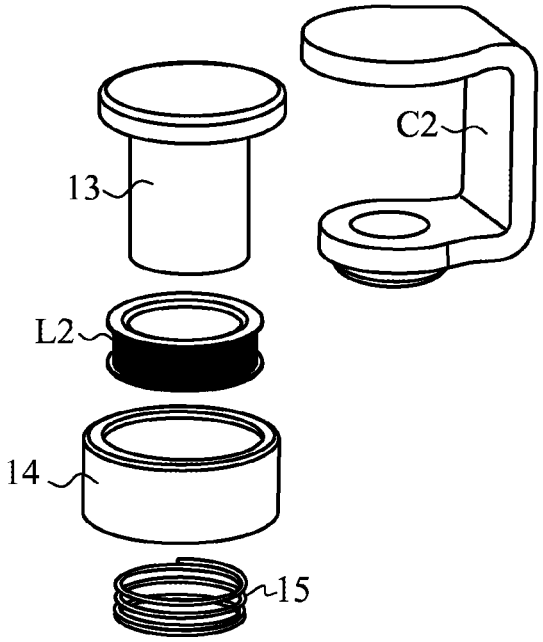
FIG. 6 is an exploded view of the micro-solenoid shown in FIG. 5.

According to the example shown, and as is more specifically shown in FIGS. 5 and 6, the second movable contact C2 is in the form of a U-shaped stirrup comprising two parallel branches 10 and 11 connected by a core 12 substantially parallel to the second coil L2. The second movable contact C2 is preferably made of a material with very good electric conductivity characteristics, such as copper, so as to support the passage of a high-intensity current without overheating.

The second coil L2 is then produced in the form of a micro-solenoid 9 comprising the mobile core P2 that is clamped by the two branches 10 and 11 of the second movable contact C2 whilst being substantially parallel to its core 12. The mobile core P2 is, for example, made of soft iron so as to be able to be magnetised and have good electric conductivity characteristics. The mobile core P2 is surrounded by the second coil L2, which is disposed inside a shell 14. Furthermore, this shell 14 is linked to the body 2 so as to be translationally immobilised parallel to the axis Δ of the coil and by translation of the core P2. Finally, the micro-solenoid 9 comprises a spring 15 interposed between the shell 14 and the lower branch 11 of the movable contact C2.

The control unit U comprises a first circuit breaker I1 dedicated to the power supply of the first coil L1 and a second circuit breaker I2 dedicated to the power supply of the second coil L2.

The output terminals of the second and first coils are electrically linked together.

The switch C that is formed in this way operates as follows.

Figure 3:
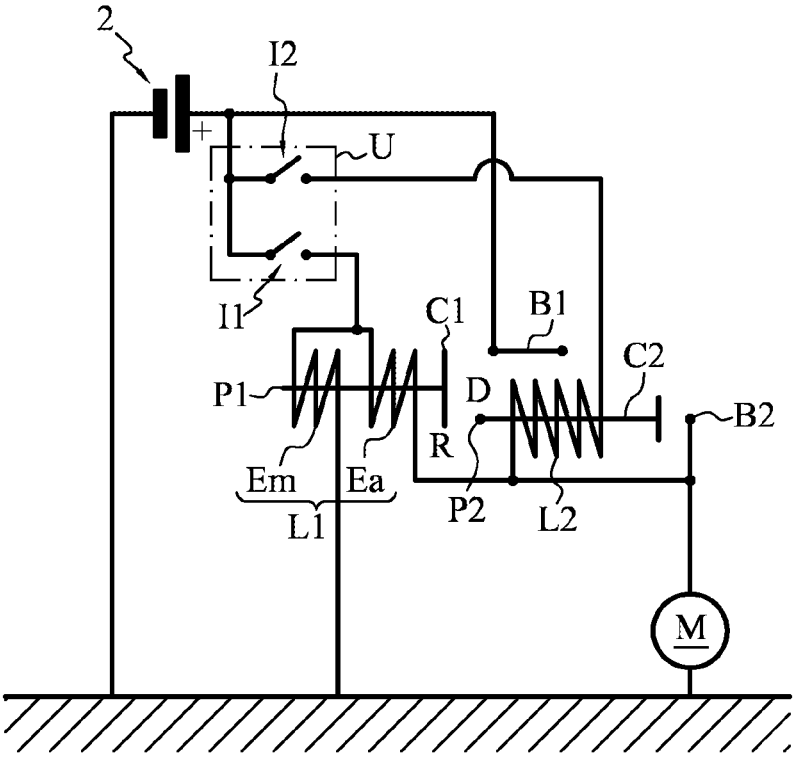
FIG. 3 is a wiring diagram of a power supply circuit of the electric motor of the starter shown in FIG. 1 incorporating the switch shown in FIG. 2.
Figure 4:
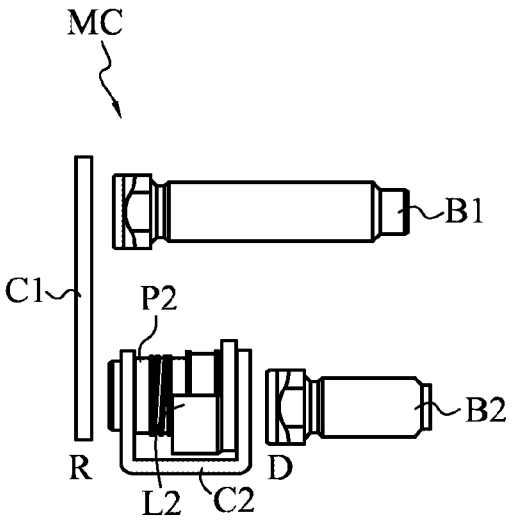
FIG. 4 is a diagram of a multi-contacts assembly constituting the switch shown in FIG. 2 in a rest state.

In a rest state, with the two circuit breakers I1 and I2 being open and no current circulating in the coils L1 and L2, the first movable contact C1 is in the rest position R and the second movable contact C2 is in the disconnected position D, as shown in FIG. 3.

Figure 7:
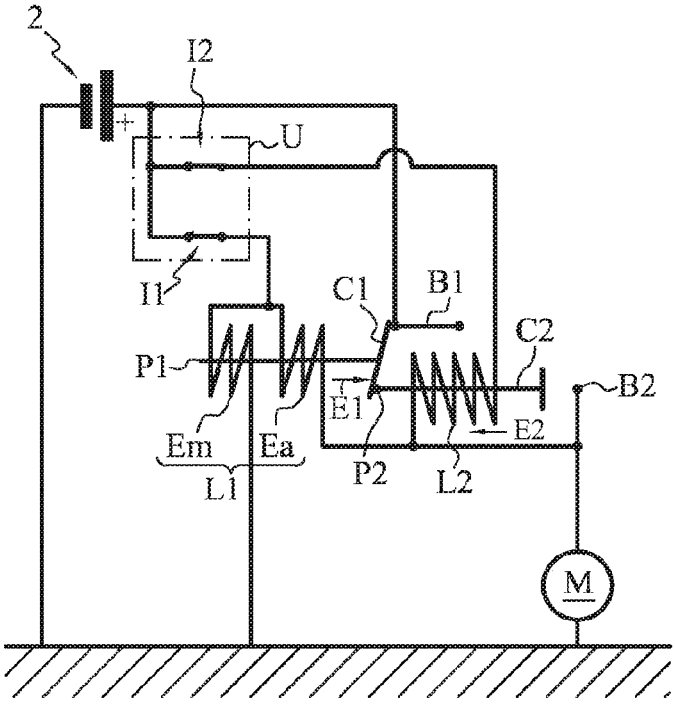
FIGS. 7 and 8 are similar diagrams to FIGS. 3 and 4, respectively, showing an engaged state of the switch shown in FIG. 2.
Figure 8:
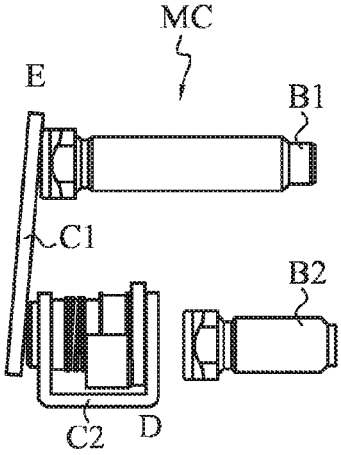

When the engine of the vehicle incorporating the starter according to the invention needs to be started, the switch C is placed in an engaged state, more specifically shown in FIGS. 7 and 8. To this end, the first circuit breaker I1 and the second circuit breaker I2 are closed.

The first coil L1 is then powered so that its plunger P1 moves in the direction of the arrow E1. The plunger P1 places the first movable contact C1 in the engaged position E where it is found in mechanical and electrical contact with the first terminal B1, as well as with the second movable contact C2. The power supply of the second coil L2 urges C2 in direction E2 and keeps the second movable contact C2 in the disconnected position D to prevent the movable contact C1 from moving the movable contact C2 toward the connected position.

The movement of the plunger P1 has also moved the launcher L to an engaged position with the drive means of the internal combustion engine.

Figure 9:
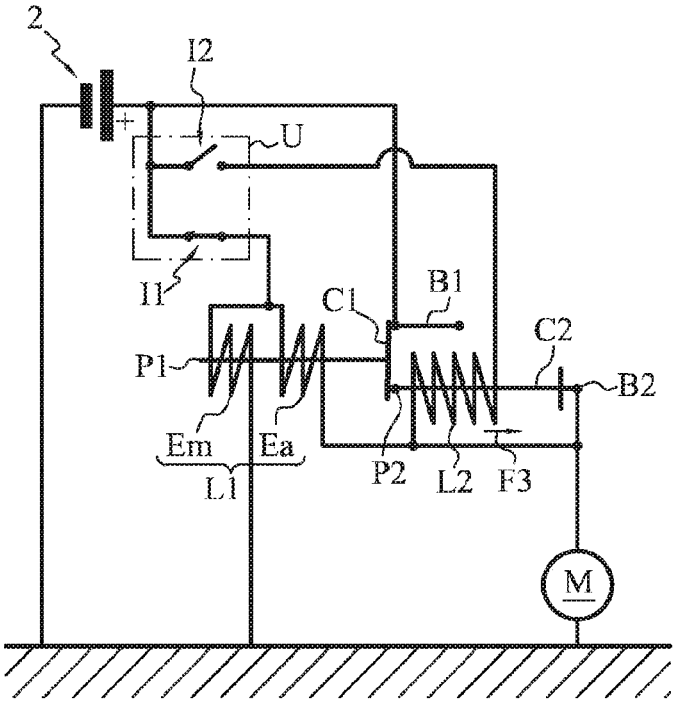
FIGS. 9 and 10 are similar diagrams to FIGS. 3 and 4, respectively, showing a power supply state of the switch shown in FIG. 2.
Figure 10:
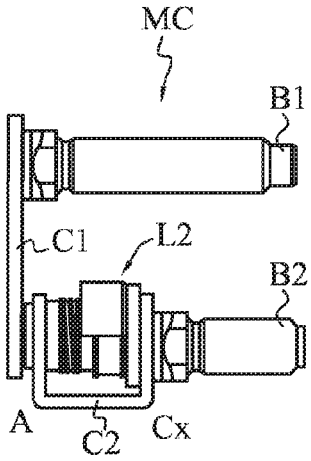

From the engaged state, the switch C can be placed in a power supply state, as shown in FIGS. 9 and 10. To this end, the second circuit breaker I2 is open so that the second coil L2 is no longer powered, which causes a translation movement of its core P2, in the direction of the arrow F3, thus placing the second movable contact C2 in the connected position Cx, in which it is in mechanical and electrical contact with the second terminal B2. The switch further comprises a retention spring W, shown in FIG. 2 , which applies a force to the movable contact C1 toward the powered position and which also applies a force to the movable contact C2 through the movable contact C1 toward the connected position.

In this way, the first C1 and second C2 movable contacts provide electrical continuity between the first B1 and second B2 terminals so that the electric motor M of the starter is powered and can ensure the drive for the internal combustion engine.

The return spring 15 exerts a force returning the movable contact to a disconnected position when the contact plate moves toward the rest position.

It is noteworthy that the first contact C1 is only perfectly placed in its engaged position when the launcher L correctly meshes with the drive means of the internal combustion engine. Therefore, the electric motor M is only powered when, on the one hand, the second circuit breaker I2 is closed and, on the other hand, the launcher L is correctly engaged.

It is also noteworthy that in this power supply state the pull-in winding Ea is short-circuited, whereas the second coil L2 is not powered so that a maximum amount of electrical power is available for the electric motor M.

According to a further variant of an embodiment, not shown, the movable contact is arranged between the movable contact C1 and the second terminal B2. The operation remains identical to the previously described mode.

Figure 11:
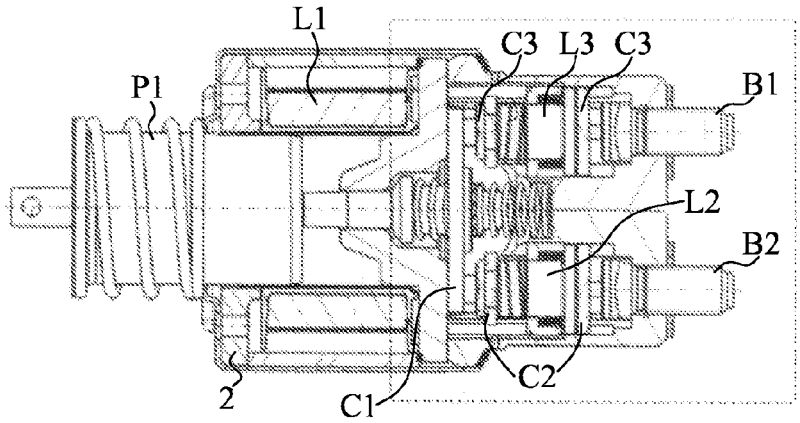
FIG. 11 is a schematic longitudinal section of a further embodiment of the electromagnetic switch of the starter shown in FIG. 1.
Figure 12:
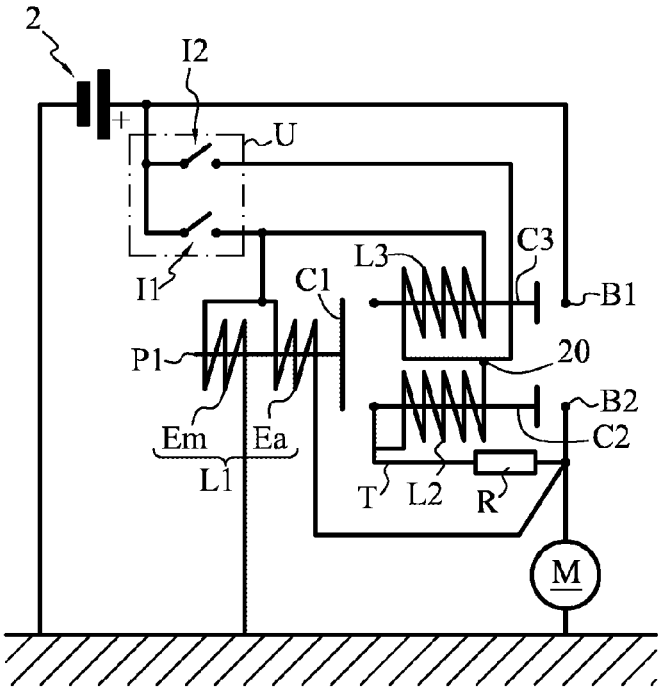
FIG. 12 is a wiring diagram of a power supply circuit of the electric motor of the starter shown in FIG. 1 incorporating the switch shown in FIG. 11.
Figure 13:
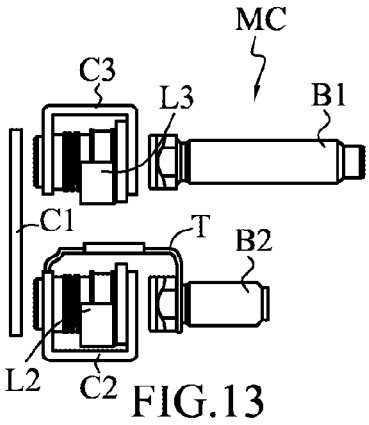
FIG. 13 is a diagram of a multi-contacts assembly constituting the switch shown in FIG. 11 in a rest state.

According to a variant of an embodiment of the invention, the switch C comprises, as shown in FIGS. 11 to 13, a third movable contact C3, which is located between the first terminal B1 and the first movable contact C1. This third movable contact C3 is activated by the core P3 of a third coil B3 produced in the same way as the second coil B2 in the form of a micro-solenoid, as shown in FIGS. 5 and 6, and for this reason its constitution does not need to be described in further detail.

According to a variant of an embodiment, the second movable contact C2 is also permanently connected to the second terminal B2 by a flexible braid T incorporating a current load resistor R.

As shown in FIG. 12, the third coil L3 is connected, on the one hand, to the second coil L2 and, on the other hand, to the first circuit breaker I1 of the control unit U, whereas the second coil L2 is connected to the second terminal B2 via the load resistor R. The second circuit breaker I2 of the control unit U is also connected to the line linking the second coil L2 to the third coil L3. In this embodiment, the second movable contact moves from a disconnected position to a shunting position, also referred to as short-circuited position, corresponding to the embodiment previously described for the connected position. In the shunting position, the resistor R is short-circuited.

The switch C that is formed in this way operates as follows.

In the rest state, as shown in FIGS. 12 and 13, with the circuit breakers I1 and I2 being open, the first movable contact C1 is in the rest position, whereas the second and third movable contacts C2, C3 are in the disconnected position, through the return spring 15 shown in FIG. 6. The movable contacts C1 to C3 and the terminals B1 and B2 are then electrically isolated from each other. The resistor R electrically links the movable contact C3 to the positive terminal of the electric motor.

Figure 14:
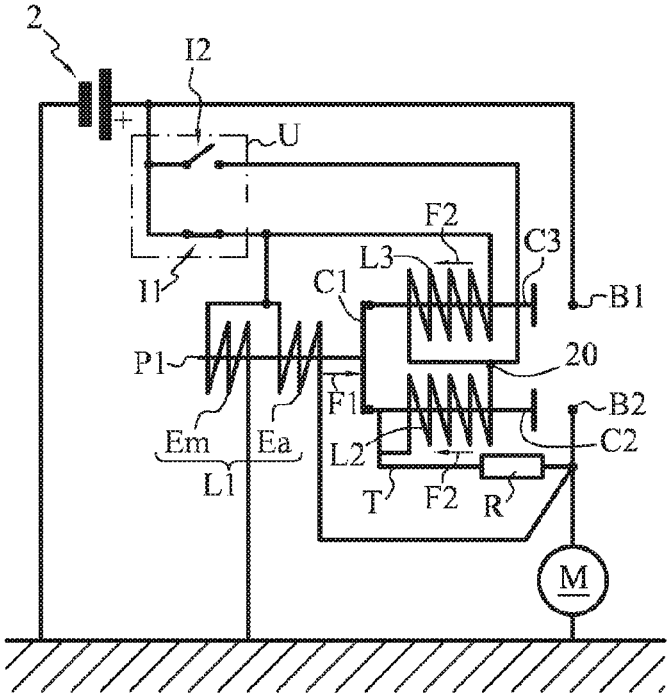
FIGS. 14 and 15 are similar diagrams to FIGS. 12 and 13, respectively, showing an engaged state of the switch shown in FIG. 11.
Figure 15:
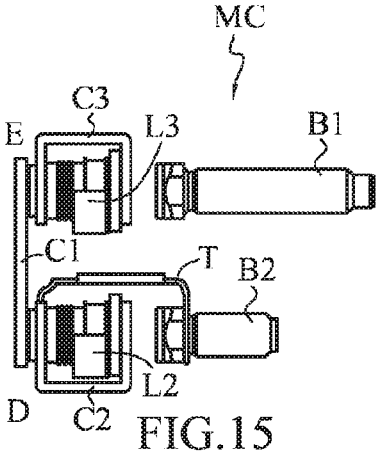

When the engine of the vehicle incorporating the starter according to this variant needs to be started, the switch C is placed in an engaged state, more specifically shown in FIGS. 14 and 15. To this end, the first circuit breaker I1 is closed, with the second circuit breaker I2 remaining open.

The first coil L1 is then powered so that its plunger P1 moves in the direction of the arrow F1. The plunger P1 places the first movable contact C1 in the engaged position E, in which it is found in mechanical and electrical contact with the second movable contact C2 and the third movable contact C3. The second coil L2 and the third coil L3 are also powered, which keeps the second movable contact C2 and the third movable contact C3 in the disconnected position through a magnetic force, shown by the arrow F2. The movement of the plunger P1 has also placed the launcher L in an engaged position with the drive means of the internal combustion engine.

Figure 16:
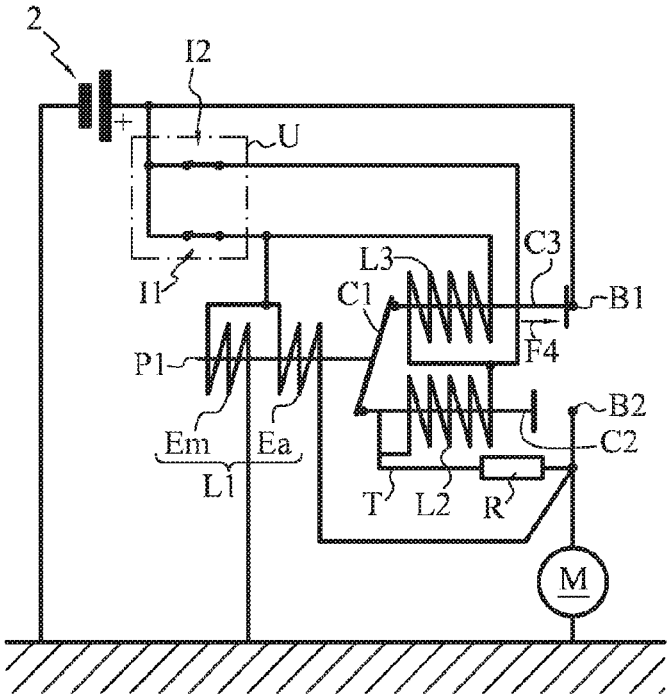
FIGS. 16 and 17 are similar diagrams to FIGS. 12 and 13, respectively, showing an intermediate state of the switch shown in FIG. 11.
Figure 17:
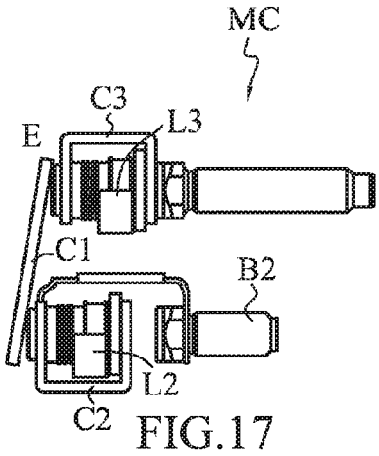

From the engaged state, the switch C can be placed in an intermediate state, as shown in FIGS. 16 and 17. To this end, the second circuit breaker I2 is closed so that the third coil L3 is short-circuited and therefore is no longer powered. The power supply fault of the third coil L3 causes a translation movement of its core P3, in the direction of the arrow F4, thus placing the third movable contact C3 in the connected position Cx, in which it is in mechanical and electrical contact with the first terminal B1. The second coil L2 is parallel to the pull-in winding Ea and thus remains powered so as to keep the second movable contact in the disconnected position.

In this intermediate state, the electric motor M is powered via the load resistor R so that it runs at reduced speed and power.

Figure 18:
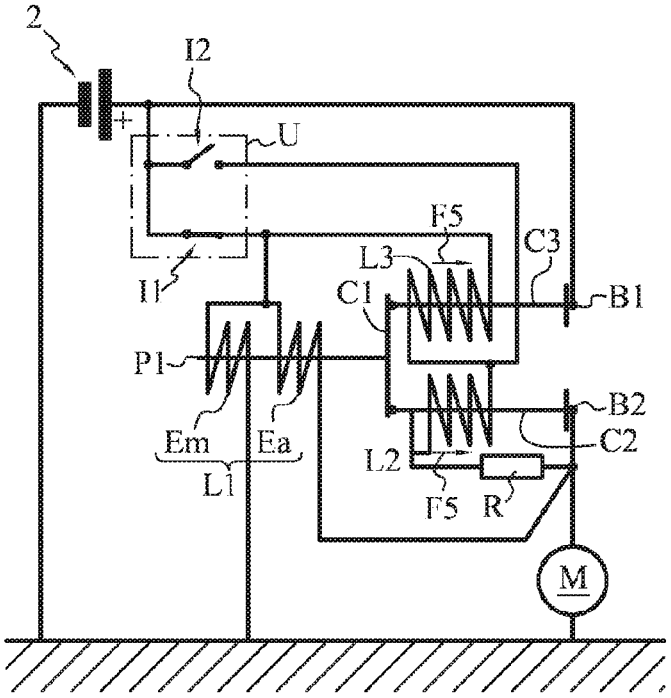
FIGS. 18 and 19 are similar diagrams to FIGS. 12 and 13, respectively, showing a power supply state of the switch shown in FIG. 11.
Figure 19:
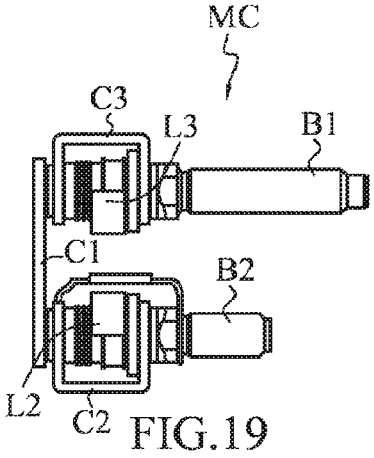
Figure 20:
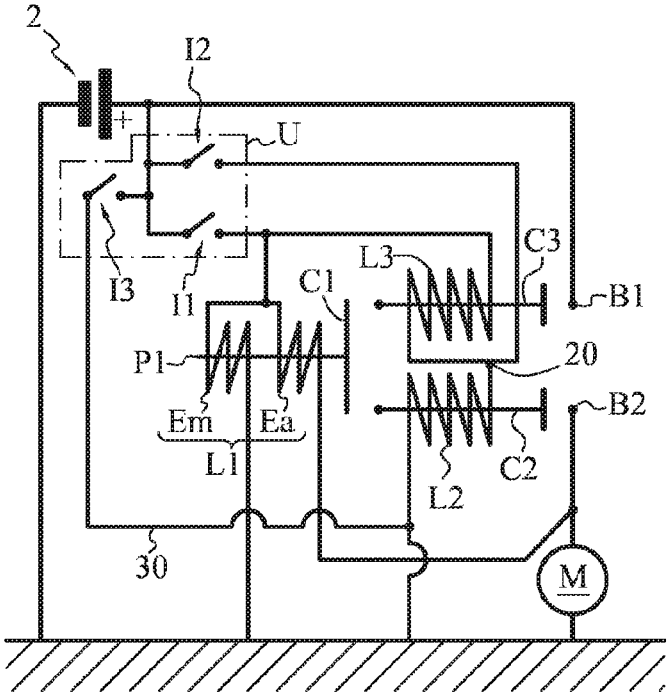
FIGS. 20 and 21 are similar diagrams to FIGS. 12 and 13, respectively, showing a further embodiment of a switch according to the invention in a rest state.
Figure 21:
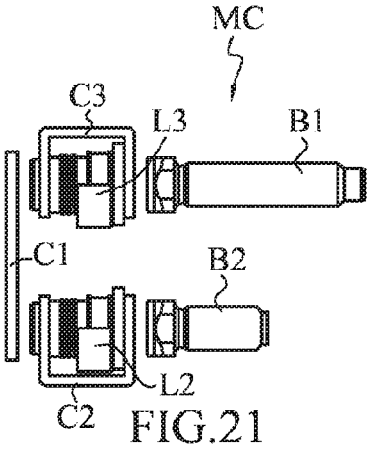

From the intermediate state, the switch C can be placed in a power supply state, as shown in FIGS. 18 and 19. To this end, the second circuit breaker I2 is open so that the power supply of at least the pull-in winding Ea of the first coil L1, as well as the power supply of the second and third coils B2 and B3, is cut so as to no longer hold the movable contact C2 and so that said movable contact moves under the action of the retention spring W, which applies a force F5 toward the connected position Cx through the movable contact C1. The second movable contact C2 in the connected position Cx is therefore in mechanical and electrical contact with the second terminal B2.

Therefore, in this power supply state, the first C1, second C2 and third C3 movable contacts provide an electrical continuity between the first B1 and second B2 terminals so that the electric motor M of the starter is fully powered and can ensure the drive for the internal combustion engine.

In this power supply state, it is sufficient, in order to interrupt the power supply of the electric motor M, for the first circuit breaker to be opened. In effect, the power supply to the holding winding is removed causing the return of the plunger P1 through one or more return springs and thus causing the second C2 and third C3 movable contacts to return to the disconnected position by means of their reciprocal return springs 15.

The second movable contact C2 is permanently linked to the second terminal by a braid T comprising the resistor R.

However, such a permanent link is not required for the invention. According to a further embodiment, not shown, the output of the second coil L2 and the input of the third coil L3 (or vice versa) are not electrically connected together. In this embodiment, a third circuit breaker is required to control the third movable contact. Therefore, the advantage of the embodiment described is that it saves volume as it only uses two movable contacts.

Of course, various other modifications can be added to the invention within the scope of the appended claims.

The invention claimed is:

1. An electromagnetic switch for the starter of a heat engine, comprising:

a first terminal (B1);

a second terminal (B2);

a first movable contact (C1), which is located between said first and second terminals (B1, B2) and which is movable between a disconnected rest position and a connected power supply position;

a core (P1), of a first coil (L1), designed to activate a system for operating a launcher (L) of said starter, controlling the displacement of said first movable contact (C1);

a second movable contact (C2), which is located between said first movable contact (C1) and said second terminal (B2) and which can be moved, between a disconnected rest position and a connected position, by a core (P2) of a second coil (L2) and by a spring, said switch being capable of being placed, according to a power supply of the coils, in three operating states:

a rest state, wherein said first movable contact (C1) is electrically isolated from said two terminals (B1, B2), and in that said two terminals are isolated from each other;

an engaged state, wherein: said first movable contact (C1) is in an engaged position between said power supply position and said rest position and is in electrical contact with said first electric terminal (B1); said second movable contact (C2) is in said rest position and is in electrical and mechanical contact with said first movable contact (C1); said second terminal (B2) is electrically isolated from said movable contacts and said first terminal (B1);

a power supply state, wherein: said first movable contact (C1) is in said power supply position and is in electrical contact with said second terminal through said second movable contact (C2) and is in electrical contact with said first terminal (B1); and said second movable contact (C2) is in a connected position and is in electrical and mechanical contact with said second terminal (B2).

2. The electromagnetic switch according to claim 1, characterized in that said second movable contact (C2) is in a connected position when said second coil (L2) is powered and is in a disconnected position when said second coil (L2) is deactivated, and in that a spring returns said movable contact to a disconnected position.

3. The electromagnetic switch according to claim 1, characterized in that said second movable contact (C2) is in a disconnected position when said second coil (L2) is powered and is in a connected position when said second coil (L2) is deactivated, and in that said second movable contact (C2) is held in a connected position by a spring.

4. The electromagnetic switch according to claim 1, characterized in that it comprises:

a third movable contact (C3), which is located between said first movable contact (C1) and said first terminal (B1) and which is moved, between a disconnected position and a shunting position, by a core (P3) of a third coil and by a spring; and a load resistor (R) electrically mounted between said first terminal (B1) and said third movable contact (C3);

wherein, in said rest state, said third movable contact (C3) is electrically isolated from the other two movable contacts (C1, C2);

in said engaged state, said first movable contact (C1) is in electrical and mechanical contact with said third movable contact (C3), and in that said third movable contact (C3) is in a disconnected position that is mechanically isolated from said third terminal and is electrically linked to said first terminal (B1) through said load resistor (R);

in said power supply state, said first movable contact (C1) is in electrical and mechanical contact with said third movable contact (C3), said third movable contact (C3) is in a connected position and is in electrical and mechanical contact with said first terminal (B1) shunting the resistor;

and wherein said switch is capable of passing to an intermediate state, in which:

said first movable contact (C1) is in an engaged position and is in electrical and mechanical contact with said second and third movable contacts (C2, C3);

said third movable contact (C3) is in a disconnected position and is in electrical contact with said first terminal (B1) through said load resistor (R); and said second movable contact (C2) is in a connected position and is electrically linked to said second terminal (B2).

5. The electromagnetic switch according to claim 4, characterized in that said third movable contact (C3) is in a disconnected position when said third terminal (L3) is activated.

6. The electromagnetic switch according to claim 4, wherein said first movable contact (C1) exerts a mechanical force on said third movable contact (C3) so as to move said third movable contact (C3) toward the shunting position when said third coil (L3) is not powered, and in that a return spring (15) applies a force to said third movable contact (C3) toward the disconnected position.

7. The switch according to claim 1, characterized in that said second (L2) and/or said third (L3) coil is a micro-solenoid.

8. The switch according to claim 7, characterized in that said second (C2) and/or third (C3) movable contact is formed by a contact stirrup comprising two branches (10, 11) that hold together a core (13) of at least one of said second (L2) and/or said third (L3) micro-solenoids, which is also located between a pair of jaws.

9. The switch according to claim 8, characterized in that said contact stirrup is adapted to support the passage of a power current.

10. The switch according to claim 8, characterized in that each of said micro-solenoids comprises a shell forming part of the magnetic circuit of said respective micro-solenoid and forming a housing for said coil of said micro-solenoid.

11. The switch according to claim 10, characterized in that said shell (14) is rigidly connected to a body (2) of said switch.

12. An electric starter for an internal combustion engine, comprising:

a launcher (L), which is rotationally driven by an electric motor (M) and which is movable by axial translation between a rest position and an engaged position with drive means of said internal combustion engine;

an electromagnetic switch (C) according claim 1 adapted, on the one hand, to control the power supply of said electric motor (M) and, on the other hand, to control the displacement of said launcher (L) between its rest and engaged positions.

13. A starter system comprising a starter according to claim 12, wherein the first coil comprises:

a pull-in coil (Ea) with an output terminal electrically linked to the positive terminal of said motor; and a holding winding (Em) with an output terminal electrically linked with the negative terminal of said motor and an input terminal linked to an input terminal of the pull-in coil;

wherein said system further comprises:

an electric battery comprising a positive terminal linked to said second terminal of said switch and a negative terminal linked to a terminal of said electric motor;

a first circuit breaker (I1) electrically linked from a first terminal to said positive terminal of said battery and from a second terminal to said holding and pull-in windings;

a second circuit breaker (I2) electrically linked from a first terminal to said positive terminal of said battery and from a second terminal to the input terminal of said second coil (L2); and wherein said output terminal of said second coil is electrically linked to said positive terminal of said motor.

14. The system according to claim 13, wherein said output terminal of said second coil is connected to said output terminal of said pull-in winding (Ea) of said first coil (L1).

15. The system according to claim 14, wherein said third coil (L3) is connected between the third contact and said output terminal of said first coil (L1).

16. The electromagnetic switch according to claim 3, characterized in that it comprises:

a third movable contact (C3), which is located between said first movable contact (C1) and said first terminal (B1) and which is moved, between a disconnected position and a shunting position, by a core (P3) of a third coil and by a spring; and a load resistor (R) electrically mounted between said first terminal (B1) and said third movable contact (C3);

wherein, in said rest state, said third movable contact (C3) is electrically isolated from the other two movable contacts (C1, C2);

in said engaged state, said first movable contact (C1) is in electrical and mechanical contact with said third movable contact (C3), and in that said third movable contact (C3) is in a disconnected position that is mechanically isolated from said third terminal and is electrically linked to said first terminal (B1) through said load resistor (R);

in said power supply state, said first movable contact (C1) is in electrical and mechanical contact with said third movable contact (C3), said third movable contact (C3) is in a connected position and is in electrical and mechanical contact with said first terminal (B1) shunting the resistor;

and wherein said switch is capable of passing to an intermediate state, in which:

said first movable contact (C1) is in an engaged position and is in electrical and mechanical contact with said second and third movable contacts (C2, C3);

said third movable contact (C3) is in a disconnected position and is in electrical contact with said first terminal (B1) through said load resistor (R); and said second movable contact (C2) is in a connected position and is electrically linked to said second terminal (B2).

17. The electromagnetic switch according to claim 5, wherein said first movable contact (C1) exerts a mechanical force on said third movable contact (C3) so as to move said third movable contact (C3) toward the shunting position when said third coil (L3) is not powered, and in that a return spring (15) applies a force to said third movable contact (C3) toward the disconnected position.

18. The switch according to claim 2, characterized in that said second (L2) and/or said third (L3) coil is a micro-solenoid.

19. The switch according to claim 3, characterized in that said second (L2) and/or said third (L3) coil is a micro-solenoid.

20. The switch according to claim 4, characterized in that said second (L2) and/or said third (L3) coil is a micro-solenoid.

21. The switch according to claim 5, characterized in that said second (L2) and/or said third (L3) coil is a micro-solenoid.

22. The switch according to claim 6, characterized in that said second (L2) and/or said third (L3) coil is a micro-solenoid.

23. The switch according to claim 9, characterized in that said micro-solenoid comprises a shell (14) forming part of the magnetic circuit of said micro-solenoid and forming a housing for said coil (L2) of said micro-solenoid.

* * * * *